US008201757B2

(12) United States Patent
Suzuki

(10) Patent No.: US 8,201,757 B2
(45) Date of Patent: Jun. 19, 2012

(54) FLOW RATE REGULATOR UNIT AND AEROSOL TYPE PRODUCT WITH FLOW RATE REGULATOR UNIT

(75) Inventor: Masato Suzuki, Tokyo (JP)

(73) Assignee: Mitani Valve Co., Ltd., Tokyo (JP)

( * ) Notice: Subject to any disclaimer, the term of this patent is extended or adjusted under 35 U.S.C. 154(b) by 605 days.

(21) Appl. No.: 12/067,965

(22) PCT Filed: Sep. 26, 2005

(86) PCT No.: PCT/JP2005/017644

§ 371 (c)(1),
(2), (4) Date: Mar. 25, 2008

(87) PCT Pub. No.: WO2007/034564

PCT Pub. Date: Mar. 29, 2007

(65) Prior Publication Data

US 2009/0250534 A1 Oct. 8, 2009

(51) Int. Cl.
*B05B 7/32* (2006.01)

(52) U.S. Cl. ..... 239/337; 222/402.1; 222/402.13; 222/496; 239/339

(58) Field of Classification Search ..... 239/337, 239/339, 353, 583, 570; 137/509; 222/402.1, 222/402.12, 402.13, 495–497
See application file for complete search history.

(56) References Cited

U.S. PATENT DOCUMENTS

| | | | | |
|---|---|---|---|---|
| 3,628,699 | A * | 12/1971 | Hendrickson et al. | 222/182 |
| 5,558,258 | A * | 9/1996 | Albini et al. | 222/496 |
| 5,657,930 | A * | 8/1997 | Battegazzore | 239/333 |
| 6,145,704 | A * | 11/2000 | Geier | 222/153.06 |
| 2008/0017666 | A1 * | 1/2008 | Vanblaere et al. | 222/135 |
| 2008/0164347 | A1 * | 7/2008 | Leuliet et al. | 239/490 |

FOREIGN PATENT DOCUMENTS

| | | |
|---|---|---|
| JP | 2004-136212 | 5/2004 |
| JP | 2004-313841 X | 11/2004 |

* cited by examiner

*Primary Examiner* — Jason Boeckmann
(74) *Attorney, Agent, or Firm* — Lucas & Mercanti, LLP

(57) ABSTRACT

A flow rate regulator of a unit structure, in which the mechanism keeps constant the amount of injection of the contents in an aerosol container independent of a variation in pressure of gas for content ejection. The flow rate regulator unit has an outer sheath member (15), an inner sheath member (16), piston members (17, 18), a coil spring (25), and an ejection piece (19). The contents are ejected in substantially the following route: "hole (15*a*)—annular space region (21) for outer path—hole (16*a*)—annular space region (22) for inner path—holes (17*b*, 18*b*)—inside path (18*c*)—valve action region (20)—penetration section (16*d*)—groove-like sections (16*f*, 19*a*)—ejection hole (19*c*)." An annular skirt section (17*a*) moves in the left-right direction based on a magnitude relation between force in the right direction caused by ejection gas pressure and acting on the piston members (17, 18) and urging force to the left direction caused by the coil spring (25), and this changes an inflow cross-sectional area from the hole (16*a*) for flow rate adjustment to the annular space region (22) for inner path.

2 Claims, 5 Drawing Sheets

FLOW RATE REGULATOR UNIT AND AEROSOL TYPE PRODUCT WITH FLOW RATE REGULATOR UNIT

TECHNICAL FIELD

The present invention relates to a flow rate regulator unit with a flow rate regulating function capable of coping with a change in pressure of contents spraying gas, and more specifically relates to a flow rate regulator unit for use in an operation button of an aerosol container and to a flow rate regulator unit for housing.

The pressure of the contents spraying gas for use in the aerosol container changes,

(11) in case of compressed gas, in response to an occupation volume of the gas in the aerosol container (substantially actual volume of the whole container minus occupation volume of residual contents);

(12) in case of liquefied gas, depending on the temperature of a use environment of the aerosol type product.

In the present specification, the term "front" indicates the side with a contents spray hole of a push button and the "rear" the opposite side.

BACKGROUND ART

The present applicant has already proposed an operation button equipped with a flow rate adjusting function capable of coping with a change in pressure of contents spraying gas as described later in references 1 and 2.

The flow rate regulator adjusting mechanism in the operation button substantially comprises the following basic components:

(21) a body (chassis) of an operation button;

(22) a cylinder mounted on the body and including a recessed part changed in the longitudinal depth to adjust the size (cross sectional area for contents passage) of a passage space region of contents flowing in from a stein and similarly including a hole part for adjustment;

(23) a sheath-shaped piston member disposed in the cylinder, which is movable longitudinally with respect to the recessed part and the hole part;

(24) a coil spring settled between the piston member and the body for energizing the piston member forwardly;

(25) an discharge piece for contents passing through the passage space region or the like.

The flow rate adjusting piston member changes an inflow cross-sectional area of the passage space region of a contents by permitting itself to move longitudinally, based on the magnitude relation between elastic force of the coil spring and spraying gas pressure received by itself.

The piston member receives backward force as a whole by the spraying gas pressure of the inflow contents, and if the backward gas pressure becomes stronger than forward energizing force of the coil spring, then the piston member moves backward.

As the piston member moves backward, the contents inflow cross-sectional area of the passage space region is reduced correspondingly to decrease an amount of the inflow contents into the piston member. In other words, backward gas pressure to the piston member is weakened.

This causes the energizing force of the coil to surpass the gas pressure and so the piston member to move forward.

The forward movement of the piston member permits the contents inflow cross-sectional area of the passage space region to again become large and permits the enough contents to flow into the piston member. Thus, the piston member moves backward with pressing force based on the spraying gas as in the time the operation was started.

In the actuation mode where the operation button is pushed, the longitudinal movement of the piston member is repeated.

In the actuation mode, as described above, in accordance with a change in the pressure of the contents spraying gas,

(31) in case of the spraying gas pressure being strong, the piston member is shortened in its time required for its movement from its front position to its rear position (substantially equal to the time interval when the contents flow anew into an internal space part of the piston member),

(32) in case of the spraying gas pressure being weak, the piston member is lengthened in the time required for its movement.

More specifically, when the spraying gas pressure is weak, the total inflow cross sectional area obtained by integrating actual inflow cross-sectional areas of the passage space region at respective time points with time is set to be large.

When the contents spraying gas pressure in the container body is high (8 $Kg/cm^2$) as in the initial stage of the use,

(41) the piston member receives large backward force based on the associated gas pressure and

(42) a backward moving speed of the piston member is high, so that a time portion in which the contents inflow through large cross sectional area of the passage space region, becomes small.

In contrast, when the contents spraying gas pressure in the container body becomes low in accordance with the use of the aerosol type product, e.g. 3 $Kg/cm^2$, compared with the case of the high gas pressure,

(51) the piston member has less backward force caused by the associated gas pressure,

(52) the piston member becomes slow in its backward motion, so that a time portion in which the contents inflow through large cross sectional area of the passage space region, is increased.

It is noted that the forward moving speed of the piston member by the coil spring is substantially not changed whatever the strength of the contents spraying gas pressure is.

Consequently, the contents inflow cross sectional area per unit time in the passage space region is automatically adjusted by a change in the contents spraying gas pressure in the container body so that it is possible to stabilize the amount of discharge of contents in aerosol products.

Reference 1: Japanese Unexamined Patent Application Publication No. 2004-136212

Reference 2: Japanese Unexamined Patent Application Publication No. 2004-313841

PROBLEMS TO BE SOLVED BY THE PRESENT INVENTION

The operation button having the foregoing flow rate adjusting function has such convenient properties that it is possible to keep the contents discharge amount per unit time substantially unchanged even though the pressure of the contents spraying gas pressure changes, as described above.

It has further another advantage that operation of the contents inflow amount adjusting part can be made to be more complete and the adjustment part and the internal peripheral surface of the cylinder or the like corresponding to the former can be prevented from being deteriorated. (see the reference 2).

However, the coil spring, one of the constituent elements of the operation button is received by part of the body (casing) of the operation button, so that the operation button includes a flow rate adjusting mechanism which surely incorporates the body. In this respect, the operation button equipped with the foregoing flow rate adjusting function must be improved.

It is an object of the present invention to provide a flow rate regulator unit which is applicable to an arbitrary operation button of different type, e.g. an operation button having separate designs formed on the surface thereof by providing anew a receiving part of the coil spring on a housing side (cylinder side in the foregoing reference of the piston member), and making the entire of the flow rate adjusting mechanism a unit structure in the form independent from the operation button.

It is another object of the present invention to provide a flow rate regulator unit which can be treated in a unit form to make convenient management and tests or the like of the flow rate adjusting mechanism It is further another object of the present invention to provide also a flow rate regulator unit for housing components common to a flow rate regulator unit for the operation button to increase application objects of the flow rate adjusting mechanism but reduce the manufacturing cost of the mechanism.

MEANS TO SOLVE THE PROBLEMS

The problems of the present invention will be solved as follows:

(1) The flow rate regulator unit comprises:

a piston member (e.g., a cylindrical piston member 17, sheath-shaped piston member 18 described later) including a contents passage (e.g., hole sections 17*b*, 18*b*, inner passage region 18*c* described later) and moving on the basis of pressure of contents spraying gas from an aerosol container;

a holding section (e.g., outer sheath-shaped section 15, inner sheath-shaped section 16, cylindrical guide section, and sheath-shaped holding section 34 described later) including:

an internal space (e.g., internal spaces of an inner sheath-shaped section 16, cylindrical guide section 32 described later) for accommodating the piston member in which the member is movable;

a hole section (e.g., a hole section 15*a*, adjusting hole sections 16*a*, 32*a* described later) for making contents in the aerosol container flow into a flow rate adjusting space region located between the hole part and the piston member; and a reception part for the piston member; and an elastic member (e.g., a coil spring 25 described later) settled between the piston member and the reception section for energizing the piston member in a predetermined direction.

(2) In the flow rate regulator unit in (1), the holding section includes a mounting section (e.g., fitting holding section 15*b* described later) of the aerosol container to a stem.

(3) In the flow rate regulator unit in (1), the holding section includes a mounting section (e.g., fitting holding section 32*f* described later) of the aerosol container to a housing.

The present invention further relates to an aerosol type product, additionally to the flow rate regulator unit having the features described above, equipped with the same.

EFFECT OF THE INVENTION

According to the present invention, the whole of the flow rate adjusting mechanism is constructed as a unit structure independent from the operation button so that it is applicable to an arbitrary operation button of different type, e.g., to an operation button of a corresponding size where a separate design is formed on the surface.

Further, the present invention enables treatment of the flow rate regulator in a unit form, which makes convenient management and tests of the flow rate adjusting mechanism.

The flow rate regulator unit for housing common components to those of the flow rate regulator unit for operation button is also provided so that application objects of the flow rate adjusting mechanism are made rich and manufacturing costs of the present mechanism can be reduced.

DESCRIPTION OF SYMBOLS

Figure 1:
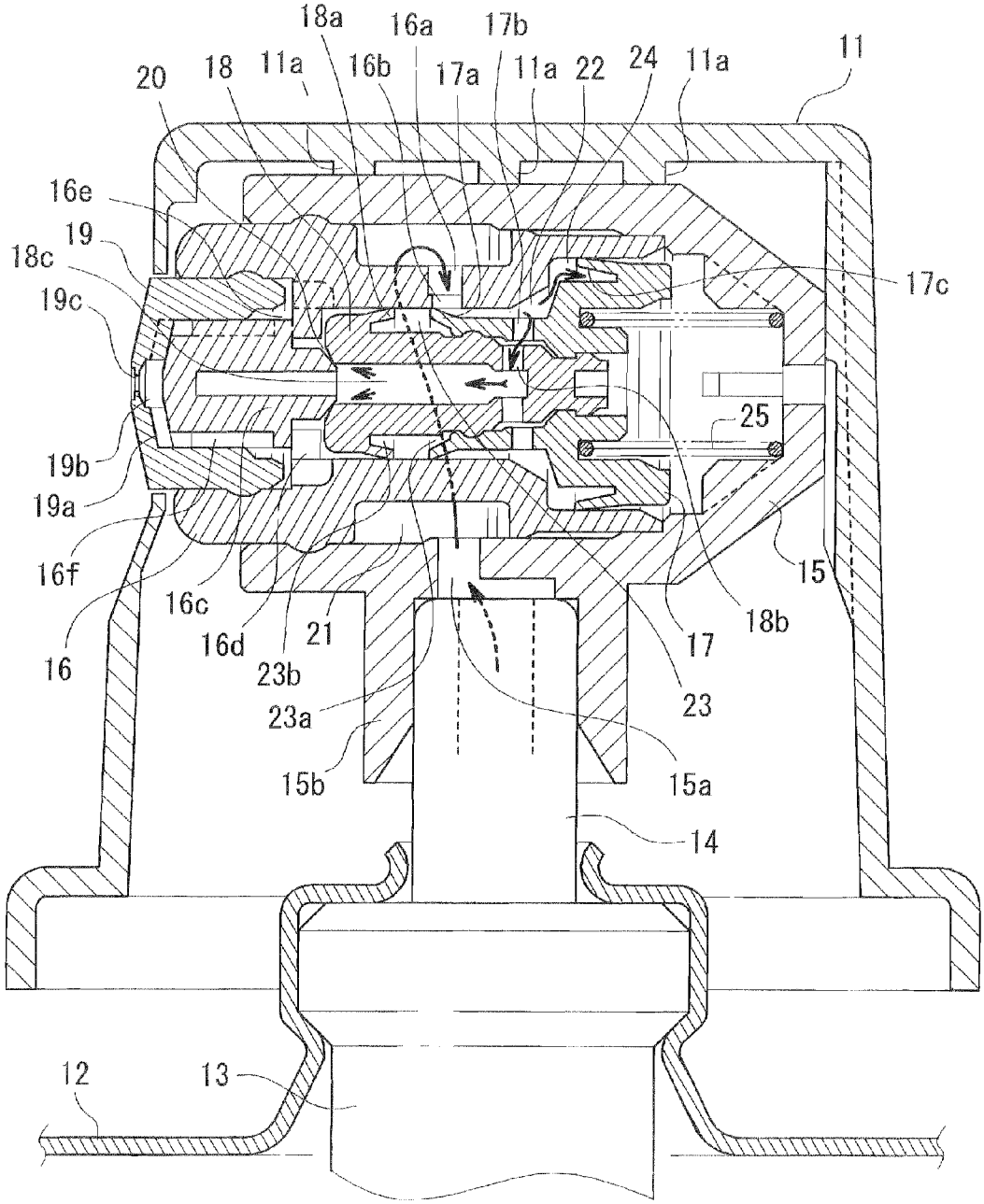
FIG. 1 is a view illustrating an operation button equipped with a flow rate regulator unit when its actuation mode is started (Embodiment 1)

In the presented figures, each component (e.g., a hole section 15*a* for contents passage) having a reference number with an alphabet is basically a part of that (e.g., outer sheath-shaped part 15 in the same figure) having the same reference number without such an alphabet:

11: A casing constituting an operation button;

11*a*: A rib formed on the ceiling surface and holding the upper portion of an outer sheath section (15) in position;

12: A container body (mounting cap) that stores various types of contents and spraying gas;

13: A housing fixed to the mounting cap;

14: A stem that accommodated in the housing to construct the valve action member, and interlocking, vertically in the figure, with the operation button;

15: An outer sheath-shaped section fitting to the stem with its upper portion and outer portion positioned to the rib (11*a*) and the inner rear surface of the casing 11;

15*a*: A hole section for contents passage;

15*b*: A fitting/holding section of the stem 14;

16: An inner sheath-shaped part fitting to the outer sheath-shaped part 15 to form an outer passage annular space region 21 described later;

16*a*: An adjustment hole section for a contents inflow amount;

16*b*: An output side opening of the adjustment hole section;

16*c*: A receiving section constituting a part of a front side of the inner sheath-shaped part and presenting a valve action between it and a sheath-shaped piston member 18;

16*d*: A penetration section for contents passage formed intermittently circumferentially of the base part region of the sheath-shaped receiving section;

16*e*: An annular recessed section formed around the sheath-shaped receiving section;

16*f*: A contents passage groove-shaped section formed substantially longitudinally of the circumferential surface of the annular recessed section;

17: A cylindrical piston member guided by inner peripheral surfaces of the inner sheath-shaped section 16 and a cylindrical guide section (FIGS. 4, 5) described later, and moving horizontally in FIG. 1 and vertically in FIG. 4;

17*a*: A first annular skirt section for inflow amount adjustment and for being guided (left side in FIG. 1, upper side in FIG. 4);

17*b*: A contents passage hole section;

17*c*: A second annular skirt section (right side in FIG. 1, lower side in FIG. 4) for being guided and for sealing;

18: A sheath-shaped piston member guided respectively by inner peripheral surfaces of the inner sheath-shaped section 16 and a cylindrical guide section 32 (FIGS. 4, 5) described later in its state fitted to the inner peripheral surface of the cylindrical piston member 17, and moving horizontally in FIG. 1 and vertically in FIG. 4;

18*a*: An annular skirt section for being guided and sealing;

18*b*: A hole section for contents passage;

18*c*: An inner passage region for contents passage leading to the hole section;

19: A sheath-shaped discharge piece fitted to the annular recessed section 16*e* of the inner sheath-shaped section 16 and held thereby;

19*a*: A groove-shaped section for contents passage formed intermittently on a bottom surface of the discharge piece intermittently in a radial direction thereof;

19*b*: A recessed section formed at the center of the bottom surface leading to a downstream side of the groove-shaped section;

19*c*: An discharge hole leading to the downstream side of the recessed section;

20: A valve action region set between the sheath-shaped receiving section 16*c* of the inner sheath-shaped section 16 and a front end of the sheath-shaped piston member 18;

21: An outer passage annular space region formed between the outer sheath-shaped section (15) and the inner sheath-shaped section (16);

22: An inner passage annular space region extending from the output side opening section 16*b* of the inner sheath-shaped section 16 to the hole section 17*b* of the cylindrical piston member 17;

23: A first buffer annular space region provided between the cylindrical piston member 17 and the sheath-shaped piston member 18 and the inner sheath-shaped section in the state leading to the output side opening section 16*b* of the inner sheath-shaped section 16;

23*a*: A pocket region located to form the inside of the first annular skirt section 17*a* of the cylindrical piston member 17;

23*b*: A pocket region located to form the inside of the annular skirt section 18*a* of the sheath-shaped piston member;

24: A second buffer annular space region provided between the inner sheath-shaped section 16 and the cylindrical piston member 17 in the state leading to the inner passage annular space region 22; and

25: A coil spring for energizing the cylindrical piston member 17 and the sheath-shaped piston member 18 to the left side in FIG. 1 and to the lower side in FIG. 4, respectively The symbols below only apply to FIGS. 4 and 5.

31: A housing fixed to the container body 12;

31*a*: A lower side cylinder section;

32: A cylindrical guide section fitted to the cylinder section and acting as guides of the cylindrical piston member 17 and the sheath-shaped piston member 18 and as the contents passage;

32*a*: A hole section for adjusting contents inflow amount;

32*b*: An output side opening of the adjustment hole section;

32*c*: A protruded stage section formed intermittently annularly of an inner peripheral surface of the cylindrical guide section to restrict upward movement positions of the cylindrical piston member 17 and the sheath-shaped piston member 18

32*d*: A central penetration region surrounded by the protruded stage section;

32*e*: A skirt section formed at the outer peripheral surface of the cylindrical guide section;

32*f*: A fitting and holding section of the cylindrical section 31*a* of the housing 31;

33: A cylindrical holding section fitted to the skirt section to accommodate a sheath-shaped holding section 34 described later;

33*a*: A lower side cylinder section;

33*b*: A contents passage hole section formed on a bottom surface leading to the cylinder section;

33*c*: A plurality of vertical ribs formed vertically on the inner peripheral surface leading to the bottom surface for holding a sheath-shaped holding section 34 described later;

34: A sheath-shaped holding section fitted to the inside of the cylindrical holding section 33 for accommodating the cylindrical piston member 17 and the sheath-shaped piston member 18 or the like;

34*a*: A plurality of lateral groove shaped sections for contents passage formed radially from a bottom center corresponding to the hole section 33*b;*

35: A contents passage tube mounted on the cylinder section 33*a;*

41: An outer passage annular space region formed between the cylindrical holding section 33 and the cylindrical guide section 32;

42: An inner passage annular space region extending from the output side opening section 32*b* of the cylindrical guide section 32 to the hole section 17*b* of the cylindrical piston member 17,

43: A first buffer annular space region provided between the cylindrical piston member 17 and sheath-shaped piston member 18, and the cylindrical guide section in the state leading to the output side opening section 32*b* of the cylindrical guide section 32;

43*a*: A pocket region adapted to form the inner area of the first annular skirt section 17*a* of the cylindrical piston member 17;

43*b*: A pocket region adapted to form the inner area of the annular skirt section 18*a* of the sheath-shaped piston member 18;

44: A second buffer annular space region provided between the cylindrical guide section 32 and the cylindrical piston member 17 in the state leading to the inner passage annular space region 42.

A united body of the cylindrical piston member 17 and the sheath-shaped piston member 18 is simply expressed as "piston members 17, 18" in the description below.

Best Mode To Embody The Invention

The basic feature of the present invention is to construct as a unit the flow rate regulator for making an amount of discharge of a contents per unit time substantially unchanged even when the pressure of contents spraying gas in a container changes.

More specifically, the flow rate regulator is constructed as a unit structure independent from a casing of an operation button in an aerosol type product and from a housing for storage of a stem, which can be set in the form of the so-called adapter to operation button casings and housings of various designs.

Although in the above description a flow rate adjusting mechanism described in the reference 2 was employed, the present invention is not limited thereto and is applicable to various types of flow rate adjusting mechanisms described in the reference 1 or the like.

Figure 2:
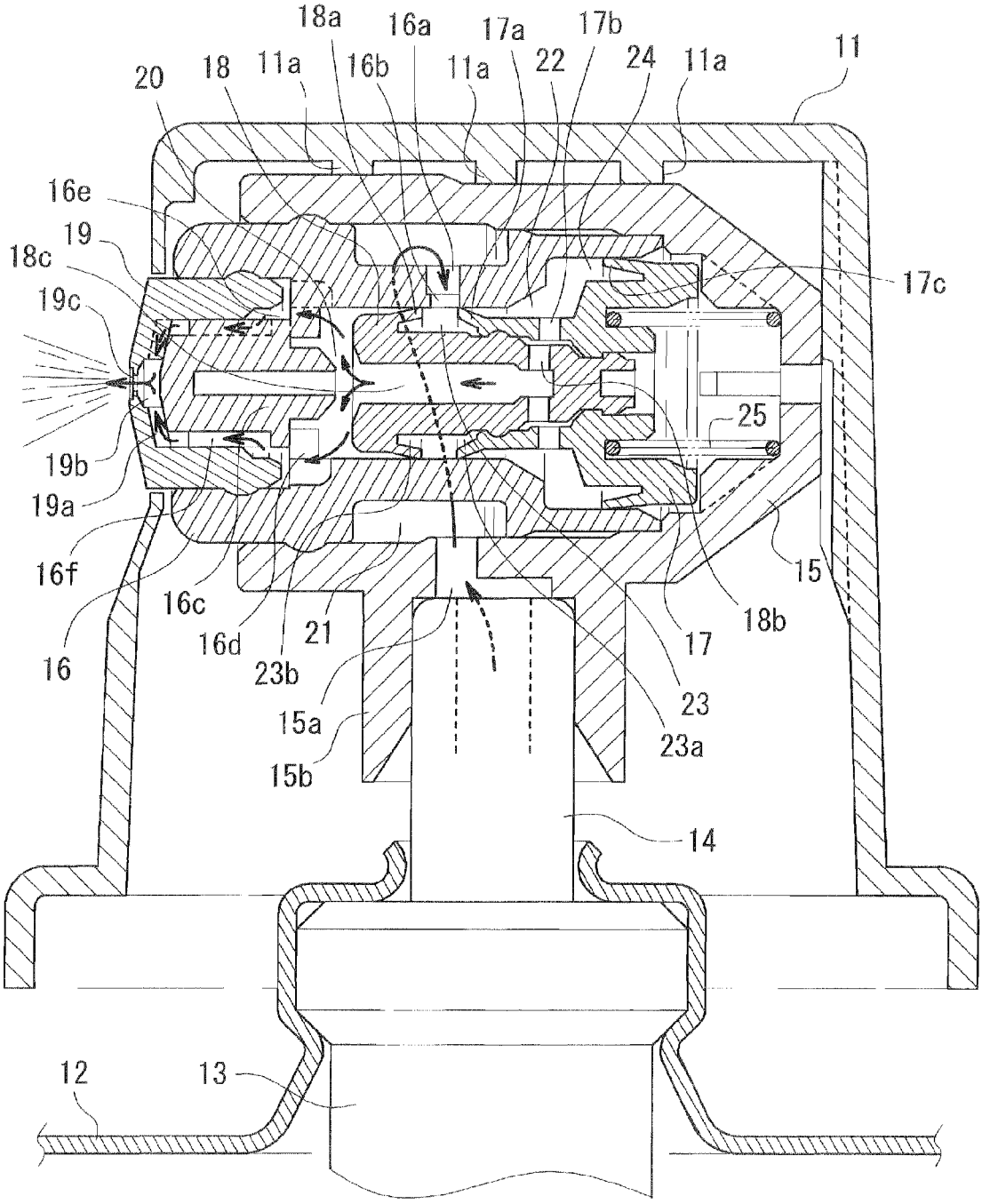
FIG. 2 is a view illustrating a piston member in the actuation mode when withdrawn (Embodiment 1)
Figure 3:
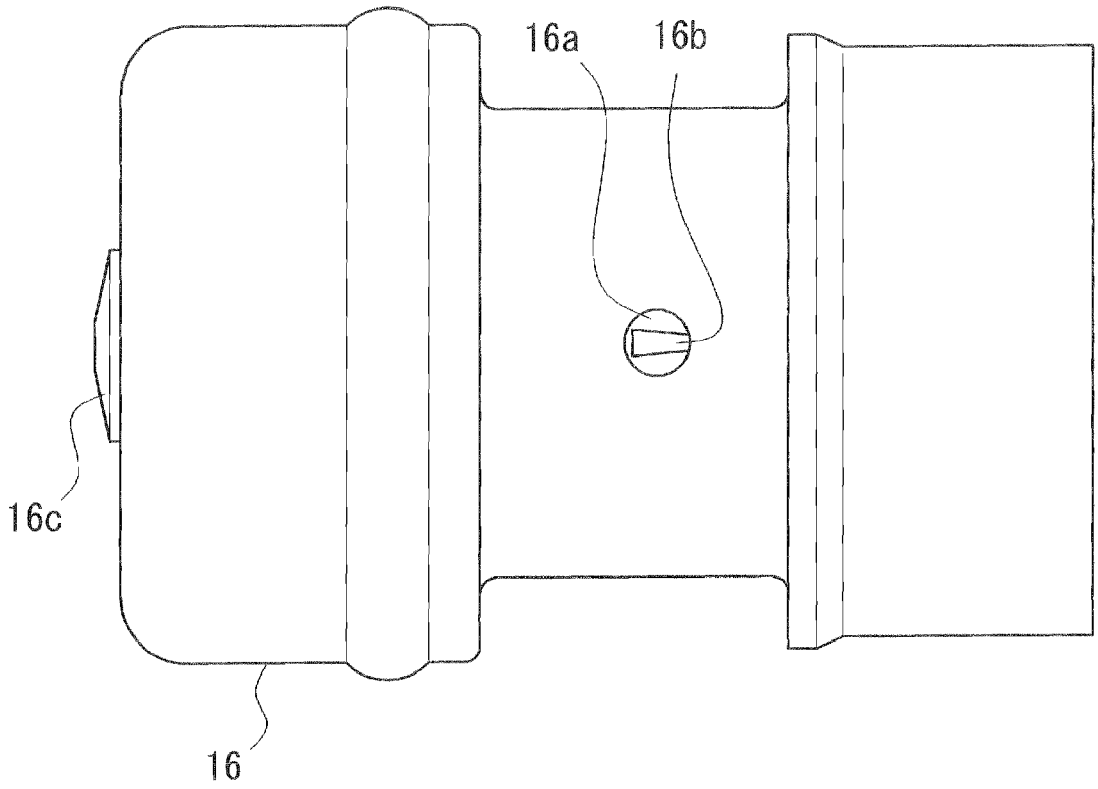
FIG. 3 is a view illustrating an inner sheath-shaped section 16 of the flow rate regulator unit when viewed from above (Embodiment 1)

Components for use in operation buttons illustrated in FIGS. 1 to 3 comprise at least five members:

outer sheath-shaped section 15

Inner sheath-shaped section 16 cylindrical piston member 17 sheath-shaped piston member 18 coil spring 25.

The components may include an discharge piece 19.

Movements of the piston members 17, 18 are controlled on the basis of relative magnitudes of the pressure of the contents spraying gas and elastic force of the coil spring 25. The principle of this mechanism is the same as that disclosed in the foregoing references.

Materials for the outer sheath-shaped section 15, inner sheath-shaped section 16, cylindrical piston member 17, sheath-shaped piston member 18, and discharge piece 19 or the like include nylon, polyacetal, polyethylene, polypropylene, polyethylene terephthalate, polybutylene terephthalate etc.

Assembling procedures of the flow rate regulator unit for button may comprise, for example,

(61) engaging the cylindrical piston member 17 and the sheath-shaped piston member 18 as a first integral article;

(62) engaging the discharge piece 19 and the inner sheath section 16 as a second integral article; and

(63) engaging the second integral section with the outer sheath section 15 while accommodating the first integral part and the coil spring as illustrated in the figure.

The discharge piece 19 may engage finally with the inner sheath-shaped section after integrating the inner sheath-shaped section 16 and the outer sheath-shaped section 15 while accommodating the first integral section and the coil spring 25 as illustrated in the figure.

The operation button is made by inserting the flow rate regulator unit after assembled into the casing 11 from below thereof. The operation button is attached to the stem.

The contents discharge passage of the aerosol container in FIGS. 1 to 3 substantially includes: container body 12—stem 14—hole section 15*a*—outer passage annular space region 21—adjusting hole section 16*a*—output side opening part 16*b*—inner passage annular space region 22—hole section 17*b*—hole section 18*b* internal passage 18*c*—valve action region 20—penetration section 16*d* rear portion of the annular recessed section 16*e* (=space region in which the discharge piece 19 is not contained)—groove-shaped section 16*f*—space region between downstream side tip end portion and the groove-shaped section 19*a*—groove-shaped section 19*a*—recessed section 19*b*—discharge hole 19*c*.

The flow rate regulator unit in FIGS. 1 to 3 is independent from the casing 11 so that it can be managed and tested in the form of a unit. The flow rate regulator unit is applicable to casings of various designs having an interface section thereto.

Operation of the flow rate regulator unit illustrated in FIGS. 1 to 3 will be described below.

In the static mode, the piston members 17, 18 move forwardly by the action of the coil spring 25 and makes contact with the reception section 16*c* of the inner sheath-shaped section 16 to close a valve action region 20 therebetween.

The annular skirt section 17*a* makes contact with a front side edge section of the adjusting hole section 16*a*, and the output side opening section 16*b* of the hole section is communicated with the hole section 17*b* of the cylindrical piston member 17. More specifically, an inflow cross section of the inside passage annular space region 22 between the first annular skirt section and the output side opening section is maximum.

In the actuation mode where the operation button (casing 11) is pressed, a valve of the stein 14 (not shown) is opened to output contents in the container body 12 to an external space through the discharge passage.

Although the contents at this time flows into the first and second buffer annular space regions 23, 24, the respective space regions are sealed with the annular skirt sections 18*a*, 17*c* without leakage of the inflow contents to the outside.

The contents entering the adjusting hole section 16*a* strikes the outer circumferential surface of the first annular skirt section 17*a*, so that the skirt section is prevented from being pressed by the energy of the inflow contents in the direction of the inner circumferential surface of the inner sheath-shaped section 16.

The piston members 17, 18 receive backward force (right direction in the figure) as a whole by spraying gas pressure of the inflow contents from the adjusting hole section 16*a*. Main action surfaces of the backward force are respective bottom surfaces of the cylindrical piston member and the sheath-shaped piston member 18 and vertical surface parts of the cylindrical piston member in contact with the second buffer annular space region 24.

When the backward force becomes larger than the energizing force of the coil spring 25, the piston members 17,18 move backward to open the valve action region 20.

When the cylindrical piston member 17 (first annular skirt section 17*a*) moves backward to reduce the inflow cross section of the output side opening part 16*b* into the inside passage annular space region 22 and further the output side opening part is closed, the amount of the inflow contents from the adjusting hole part 16*a* is reduced to lessen the spraying gas pressure small and to permit the energizing force of the coil spring 25 to become dominant.

The piston members 17, 18 hereby return forward and the inflow cross section returns to an initial state where the inflow cross section is wide. The piston members do not necessarily go forward until it makes contact with the reception section 16*c* of the inside sheath-shaped section 16 (the valve action region 20 is closed).

The contents in the container body 21 is discharged to the external space through the foregoing passage while repeating such a reciprocation motion of the piston members 17,18 in forward and backward directions.

Required time for the backward movement of the piston members 17, 18 changes in response to the magnitude of the spraying gas pressure to perform the flow rate adjustment of the contents.

As illustrated in FIG. 3, the output side opening section 16*b* of the adjustment hole section 16*a* is elongated in a backward direction and is more narrowed in its width as it goes to the backward.

Consequently, the contents flowing into the adjusting hole section 16*a* from the outer passage annular space region 21 becomes a laminar flow after passing the outer opening section 16*b* and advances to the hole section 18*b* of the sheath-shaped piston member 18 to improve the responsibility of the backward movement of the piston members 17, 18.

The number and formation position of the adjusting hole section 16*a*, and the installation position of a front end of the first annular skirt section 17*a* in the static mode in FIG. 1 and in the actuation mode in FIG. 2 (and the piston members 17, 18 are most retired) are arbitrary under the conditions that the contents in the actuation mode can flow into the hole sections 17*b*, 18*b* of the piston members 17, 18 from the adjusting hole part.

For example, also in the state where the piston members 17, 18 are most retired in the static mode and actuation mode the front end of the first annular skirt section 17*a* may be opposed to the output side opening section 16*b* of the inner sheath-shaped section 16.

In the embodiment 1, a unit composed of the outer sheath-shaped section 15, inner sheath-shaped part 16, cylindrical piston member 17, sheath-shaped piston member 18, coil spring 25, and discharge piece 19 may be set to the stem 114 without being mounted on the casing 11 as it is to make the unit itself an operation button.

It is noted that instead of the coil spring 25 an arbitrary elastic member such as various types of springs and leaf springs may be employed.

Embodiment 2

Figure 4:
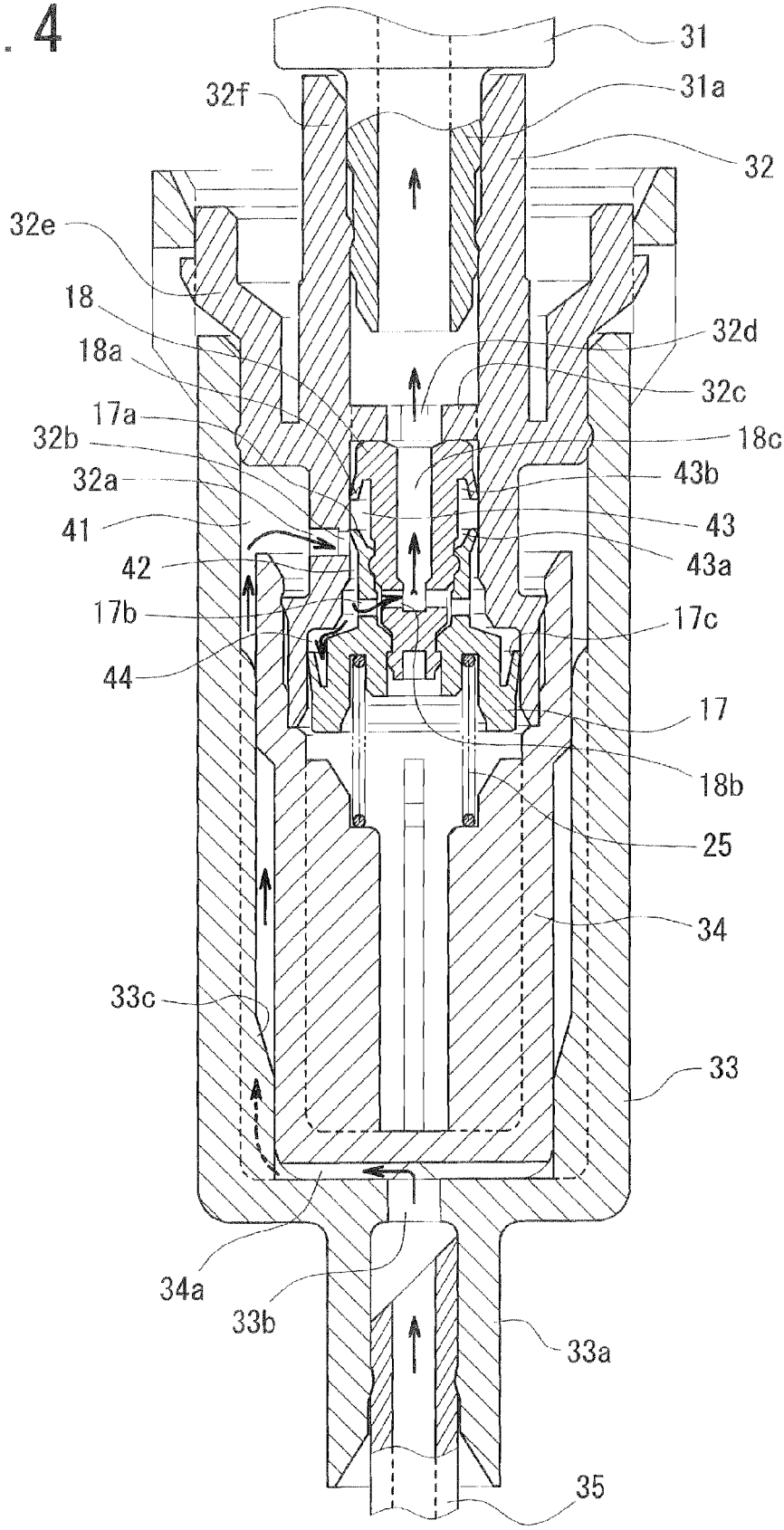
FIG. 4 is a view illustrating a housing equipped with the flow rate regulator unit when its actuation mode is started (Embodiment 2)
Figure 5:
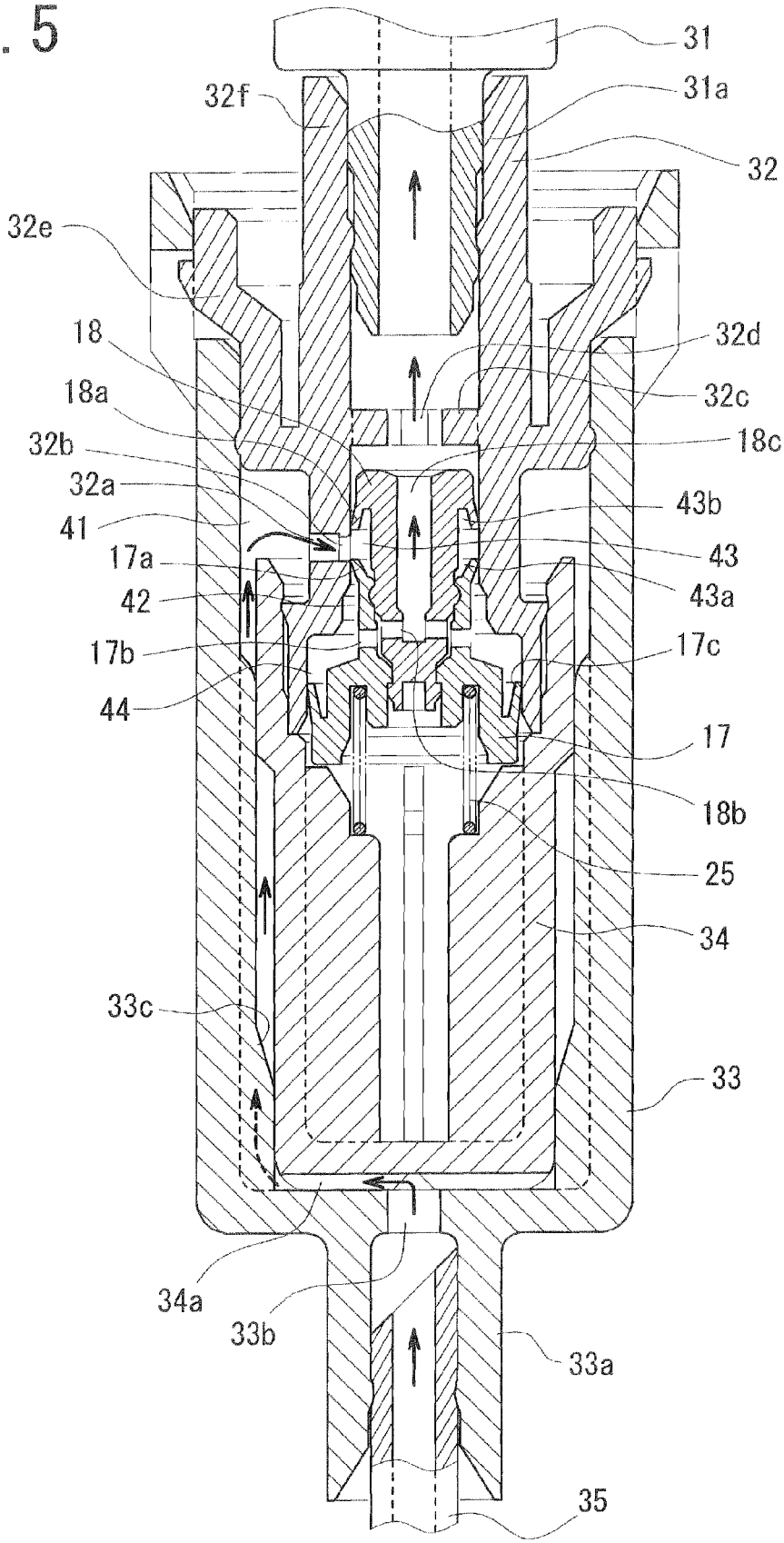
FIG. 5 is a view illustrating the piston member in the actuation mode when it is withdrawn (Embodiment 2).

Six components of the flow rate regulator unit in FIGS. 4, 5 are as follows:

cylindrical piston member 17
sheath-shaped piston member 18
coil spring 25
cylindrical guide section 32
cylindrical holding section 33
sheath-shaped holding section 34

The cylindrical piston member 17, sheath-shaped piston member 18, and coil spring 25 are the same as components of the flow rate regulator unit for the operation button in FIGS. 1 to 3.

Other components correspondingly include: for example,

(71) a cylindrical guide section 32 to the inner sheath-shaped section 16,

(72) a recessed step section 32*c* to the reception section 16*c*,

(73) a combined cylindrical holding section 33 and sheath-shaped holding section 34, or a sheath-shaped holding section 34 to the outer sheath-shaped section 15,

(74) an adjusting hole section 32*a* of a cylindrical guide section 32 to the adjusting hole section 16*a* of the inner sheath-shaped section 16,

(75) a contents passage hole section 33*b* of a cylindrical holding section 33 to the contents passage hole section 15*a* of the outer sheath-shaped section 15, and

(76) respective components 41 to 44 in FIGS. 4, 5 to those 21 to 24 in FIGS. 1, 2, 3.

It is of course that a protruded step section 32*c* of the cylindrical guide section 32 does not present such a valve action as that of the reception section 16*c*.

The description of the operation of the flow rate regulator unit for operation button in FIGS. 1 to 3 under the foregoing correspondence is applicable to that for housing in FIGS. 4, 5.

The principle of the movement of the piston members 17, 18 is also the same as those of the foregoing references.

Materials of the cylindrical piston member 17, sheath-shaped piston member 18, cylindrical guide section 32, cylindrical holding section 33, and sheath-shaped holding section 34 include nylon, polyacetal, polyethylene, polypropylene, polyethylene terephthalate, polybutylene terephthalate or the like.

Assembling procedure of the flow rate regulator unit for housing in FIGS. 4, 5 comprises, for example,

(81) forming a third integral product by fitting the cylindrical piston member 17 and the sheath-shaped piston member 18;

(82) forming a fourth integral product by fitting the cylindrical guide section 32 and the sheath-shaped holding section 34 in a state where the third integral product and the coil spring 25 are contained as illustrated in the figure;

(83) inserting the fourth integral product into the cylindrical holding section 33 from above and fitting them.

The flow rate regulator unit after assembled includes the cylindrical guide section 32 mounted on the cylindrical section 31*a* of the housing 31 in a fitting state and the tube 35 attached to the cylindrical section 33*a*.

Hereby, the flow rate regulator unit is set between the tube 35 and the housing 31.

The contents discharge passage in FIGS. 4, 5 substantially comprises: the container body 12—tube 35—hole section 33*b*—lateral groove-shaped section 34*a*—space region between downstream side tip end section of the lateral groove-shaped section and the longitudinal rib 33*c*—groove-shaped section between the longitudinal ribs 33*c*—outer passage annular space region 41—adjusting hole section 32*a*—output side opening section 32*b*—inner passage annular space region 42—hole section 17*b*—hole section 18*b*—inner passage region 18*c*—central through region 32*c*—cylindrical section 31*a*.

In the flow rate regulator unit for housing the valve action region 20, etc., used in FIGS. 1 to 3 are unnecessary. For this, ordinary contents discharge is possible also under the spraying gas pressure where no flow rate adjusting action is required.

Further, by increasing the air space region in which the coil spring 25 is contained an influence of an air compression load on a spring load is reduced to the utmost. In other words, an influence on the flow rate adjusting action is reduced.

The flow rate regulator unit in FIGS. 4, 5, which is independent from the housing in the container, can be managed and tested in the form of a unit. This is applicable to various housings each having an interface with the unit structure.

Embodiment 3

Aerosol type products to which the present invention is applicable include various applications such as cleansing agents, cleaning agents, antiperspirants, coolants, muscle antiphlogistic agents, hair styling agents, hair treatment agents, hair washing agents, hair restorers, cosmetics, shaving foams, foods, droplet like products (such as vitamin), medical goods, quasi drugs, coating materials, gardening agents, repellant agents(insecticides), cleaners, deodorants, laundry starch, urethane foams, extinguishers, adhesives, lubricant agents or the like.

Contents accommodated in the container body include powdery products, oil components, alcohols, surfactants, high polymers, and effective components associated with various applications.

Powdery products includes metal salts powder, inorganic powder, and resin powder or the like, e.g. talc, kaolin, aluminum hydroxychloride (aluminum salt), calcium arginate, powdered gold, silver powder, mica, carbonate, barium sulphate, cellulose, and mixtures of them.

Oil components include silicone oil, palm oil, eucalyptus oil, camellia oil, olive oil, jojoba oil, paraffin oil, myristic acid, palmitic acid, stearic acid, linoleic acid, linolenic acid or the like.

Alcohols include monovalent lower alcohol such as ethanol, monovalent higher alcohol such as lauryl alcohol, and multivalent alcohol such as ethylene grycol or the like.

Surfactants include anionic surfactant such as sodium laurylsulphate, non-ionic surfactant such as polyoxiethylene oleyl ether, amphoteric surfactant such as lauryl dimethyl amino acetic acid betaine, and cationic surfactant such as alkylchloride trimethylammonium or the like.

Polymer molecule compounds include methylcellulose, gelatine, starch, and casein or the like.

Effective components associated with respective applications include antiphlogistics/analgesics such as in ethyl salicylate and indometacin, bacteria elimination agents such as sodium benzoate and cresol, harmful insect extermination agents such as pyrethroid, diethyltoluamide, anhidrotics such as zinc oxide, algefacient such as camphor and peppermint camphor, antiasthmatic agents such as ephedrine and adrenaline, edulcorant such as sucralose and aspartame, adhesive and paint such as epoxy resin and urethane, dyes such as paraphenylenediamine and aminophenol, and extinguishant such as ammonium dihydrogenphosphate and sodium/potassium acid carbonate or the like.

Further, there are usable suspensions, UV absorbers, emulsifiers, humectants, antioxidants, and metal ion blocking agents, etc.

Contents spraying gas in the aerosol type product includes carbon dioxide, nitrogen gas, compressed air, oxygen gas, lean gas, compressed gas of mixed gas etc. of the former gases, liquefied petroleum gas, and liquefied gas of dimethyl ether and fluorocarbon etc.

What is claimed is:

1. A flow rate regulator unit mounted in a casing section, comprising:

a piston member, including an inner content passage inside the piston member, an opening in a sidewall of the piston member which is in fluid communication with the inner content passage, and an outwardly extending skirt on the sidewall of the piston member, the piston member movable from a forward position to a rearward position in response to pressure of content spraying gas in an aerosol container;

a holding part, including an internal space for accommodating said piston member, where said piston member is movable, a hole in a sidewall of the holding part for allowing a content in the aerosol container to flow into a flow rate adjusting space located between said hole and the outwardly extending skirt of the piston member, the opening in the sidewall of the piston member being in fluid communication with the flow rate adjusting space when the piston member is in the forward position and the outwardly extending skirt blocking the fluid communication between the opening and the flow rate adjusting space when the piston member is in the rearward position, a receiving section for receiving a front end of the piston member, acting valve function therewith, and a mounting section on the sidewall of the holding part for connecting the holding part to a stem of the aerosol container; and an elastic member positioned between a rear end of said piston member and an inner rear end surface of said holding part for energizing said piston member in the forward position;

wherein the holding part is a separate member from the casing section, and the casing section is composed of a single member which is movable in a downward direction, toward the aerosol container by a pressing operation by a user, and wherein the flow rate regulator unit is a unit structure independent from the casing section, and the flow rate regulator unit is mounted in the casing section and on said stem.

2. An aerosol product, comprising the flow rate regulator unit mounted in the casing section according to claim 1.

* * * * *